United States Patent [19]

Tanaka

[11] Patent Number: 4,731,893

[45] Date of Patent: Mar. 22, 1988

[54] METHOD OF CAUSTIC ALKALI TREATMENT FOR KNITTED WORK

[75] Inventor: Masaharu Tanaka, Kyoto, Japan

[73] Assignees: Masatoyo Tanaka; Setsuko Tanaka; Kazuko Tsukamoto, all of Kyoto, Japan

[21] Appl. No.: 805,603

[22] Filed: Dec. 6, 1985

[51] Int. Cl.[4] ..... D06B 7/10

[52] U.S. Cl. ..... 8/151; 68/9; 68/13 R; 68/62

[58] Field of Search ..... 8/151, 128; 26/82, 1, 26/96; 68/9, 13 R, 62

[56] References Cited

U.S. PATENT DOCUMENTS

| | | | |
|---|---|---|---|
| 1,979,762 | 11/1934 | O'Kane et al. | 26/82 X |
| 2,142,043 | 12/1938 | Boyd | 68/9 X |
| 2,239,636 | 4/1941 | Weiss | 26/1 |
| 2,620,544 | 12/1952 | Mullen | 68/9 X |
| 2,678,483 | 5/1954 | Lasley | 26/1 |
| 2,769,685 | 11/1956 | Cowles et al. | 68/13 R X |
| 3,132,986 | 5/1964 | Goldman | 26/1 X |
| 3,196,723 | 7/1965 | Cohn et al. | 26/1 X |
| 4,155,227 | 5/1979 | Conti | 68/13 |
| 4,166,367 | 9/1979 | Sando et al. | 68/9 |
| 4,377,388 | 3/1983 | Mains | 8/151 |

*Primary Examiner*—Harvey C. Hornsby
*Assistant Examiner*—Frankie L. Stinson
*Attorney, Agent, or Firm*—Wenderoth, Lind & Ponack

[57] ABSTRACT

The present invention is directed to a method of caustic alkali treatment, wherein the knitted work extended in the lengthwise direction and shrunken in the widthwise direction due to the scouring (or degumming) and the bleaching treatment is, after being returned to the condition of the length and the width before the scouring (or degumming) and bleaching treatment, able to be subjected to the caustic alkali treatment and the washing treatment as it is in such a natural state as when it is knitted by a knitting machine, whereby the knitted work is never short of width as is the case with the prior art method of treatment.

4 Claims, 13 Drawing Figures

METHOD OF CAUSTIC ALKALI TREATMENT FOR KNITTED WORK

BACKGROUND OF THE INVENTION

1. Field of the Invention

The present invention generally relates to a method of caustic alkali treatment of a knitted work.

2. Description of the Prior Art

Two conventional methods of caustic alkali treatment for knitted work are known, namely, (1) to treat the knitted work as is in the shape of a tube and (2) to treat the knitted work after cutting open the same into the form of a cloth from the shape of a tube.

The demerits in the case where the knitted work is subjected to the caustic alkali treatment are as follows. Specifically, since the knitted work shrinks in the widthwise direction and at the same time, extends in the lengthwise direction during the process of the scouring (or degumming) and the bleaching treatment, the knitted work remains shrunken in the widthwise direction and extended in the lengthwise direction after the completion of the caustic alkali treatment, resulting in a disadvantage such that a product made of the knitted work considerably unfavorably shrinks in the wash. Moreover, the caustic alkali treatment is conducted in the manner that the opposite left and right ends of the tubular knitted work are held down, and therefore, when one of the opposite left and right ends is cut open to be unfolded after the treatment, the knitted work thus unfolded is stained with a striped mark, that is, a so-called "center mark" in the center thereof.

On the other hand, the demerits in the case where the knitted work is subjected to the caustic alkali treatment after it is cut open into the form of a cloth are as follows. That is, the knitted work which shrinks in the widthwise direction and extends in the lengthwise direction due to the scouring (or degumming) and the bleaching treatment remains as is, even through the caustic alkali treatment, and accordingly, it is disadvantageous that the knitted work is apt to be short of width, or the product made of the knitted work undesirably shrinks in the wash.

Meanwhile, in order to eliminate the disadvantages or demerits found in the case where the knitted work is subjected to the caustic alkali treatment in the form of an unfolded cloth, there is a way to bring the knitted work first into the caustic alkali treatment without the scouring (or degumming) and bleaching treatment done, and then into the scouring (or degumming) and the bleaching treatment. In accordance with this manner of caustic alkali treatment before the scouring (or degumming) and the bleaching treatment, although the product does not shrink in the wash, it lacks good luster, nor does the caustic alkali treatment have a good effect.

As is explained above, it has been impossible to produce a satisfactory product in accordance with the prior art caustic alkali treatment. Particularly, in consequence of the spread of washing machines equipped with driers of tumble-dry system in recent years, such an improvement is strongly desired for a process which can prevent the product of the knitted work treated in accordance with the above-described (1) or (2) method from shrinking even after the product is washed and dried by a washing machine with a tumble-dry drier.

SUMMARY OF THE INVENTION

Accordingly, an essential object of the present invention is to provide an improved method of caustic alkali treatment for knitted work which can prevent the knitted work from being changed, when it is subjected to the caustic alkali treatment, from in the natural condition into the condition short of width in which the knitted work is extended in the lengthwise direction and shrunken in the widthwise direction thereby preventing the knitted work from shrinking in the wash.

In accomplishing this object of the present invention, a method of caustic alkali treatment embodying the present invention comprises the steps of: returning the knitted work of cylindrical shape which is extended in the lengthwise direction and is shrunken in the widthwise direction during the process of the scouring (or degumming) and the bleaching treatment into the condition before the scouring (or degumming) and the bleaching treatment by a shrink-proofing apparatus so as to remove the strain; cutting open the knitted work of cylindrical shape into the form of an unfolded cloth by a cutting tool; sending said knitted work in the form of an unfolded cloth successively into a tank containing therein a solution of caustic alkali so that said knitted work is soaked in the solution of caustic alkali; transferring said knitted work on a tenter provided in succession to said tank and moved at completely the same speed as that at which said knitted work is successively sent into the tank of caustic alkali solution; and washing said knitted work being transferred on the tenter by the shower of water from above and below the knitted work so as to remove the caustic alkali.

BRIEF DESCRIPTION OF THE DRAWINGS

This and other objects and features of the present invention will be apparent from the following description taken in conjunction with one preferred embodiment thereof with reference to the accompanying drawings, in which.

DETAILED DESCRIPTION OF THE INVENTION

Figure 1:
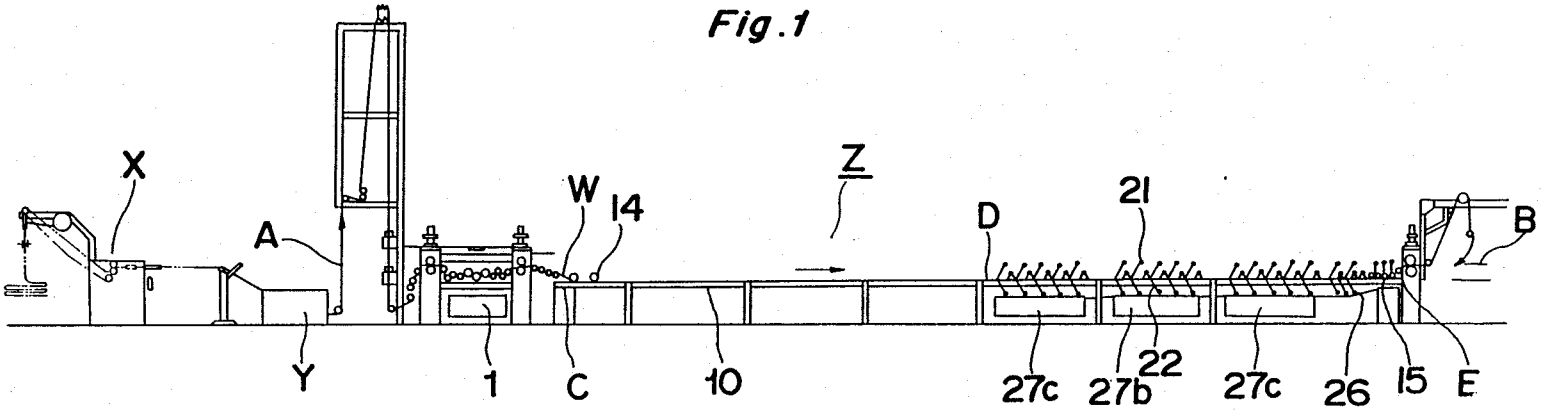
FIG. 1 is a front elevational view of a mercerization machine equipped with a washing device embodying a method according to the present invention.

Before the description of the present invention proceeds, it is to be noted that like parts are designated by like reference numerals throughout several views of the accompanying drawings.

A knitted work subjected to a caustic alkali treatment is adapted to pass in a line through a shrink-proofing apparatus X, a cutting tool Y, and then, a mercerization machine Z. The shrink-proofing apparatus X treats the knitted work of cylindrical shape, which expands in the lengthwise direction and shrinks in the widthwise direction during the process of the scouring (or degumming) and bleaching treatment, to return to the condition before the scouring (or degumming) and the bleaching treatment so as to remove the strain from the knitted work. Then, the cutting tool Y is provided to cut open the knitted work of cylindrical shape into the form of an unfolded cloth in a normal manner.

Figure 2:
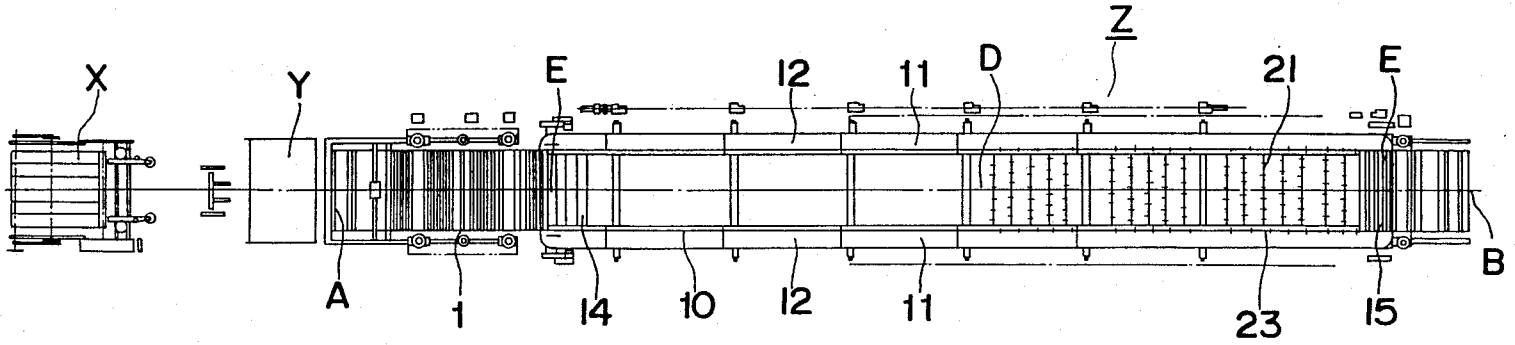
FIG. 2 is a plan view of FIG. 1.
Figure 3:
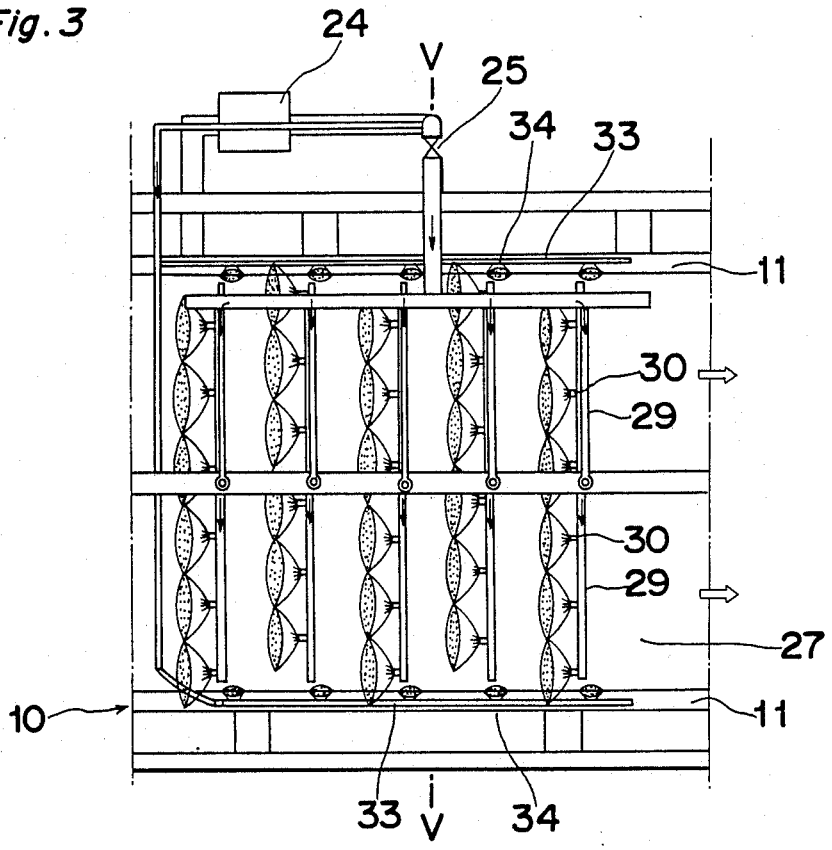
FIG. 3 is a view of the washing device of FIG. 1, partially on an enlarged scale.
Figure 4:
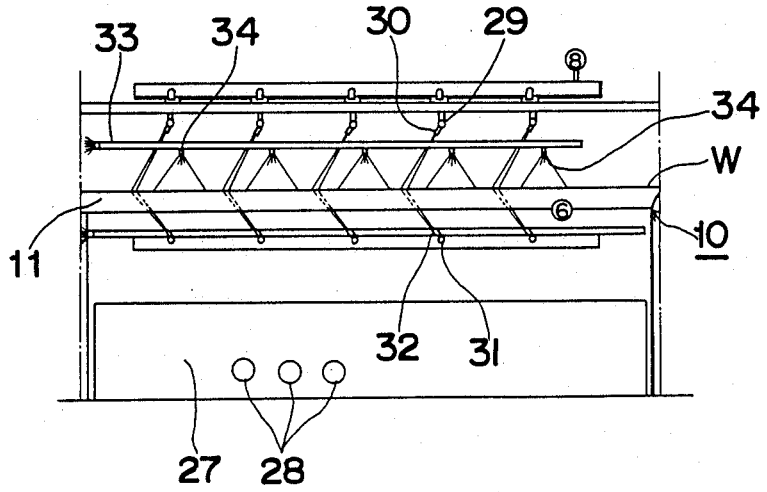
FIG. 4 is a front elevational view of FIG. 3.
Figure 5:
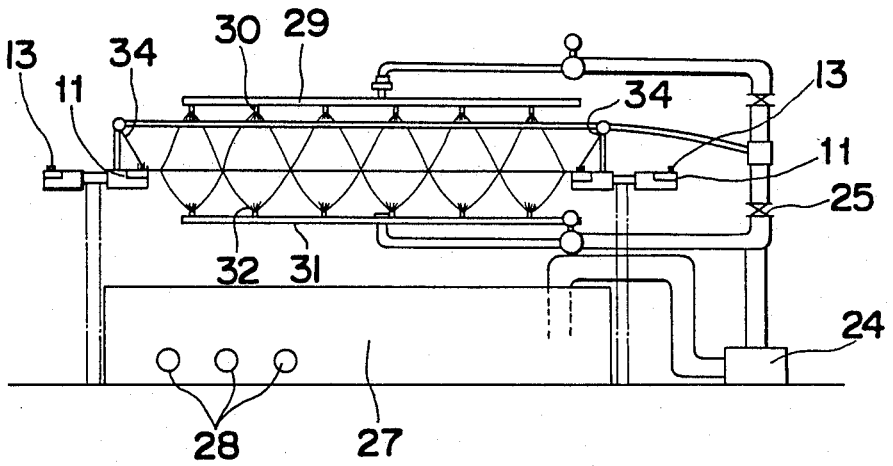
FIG. 5 is a cross-sectional view taken along the line V—V of FIG. 3.
Figure 6:
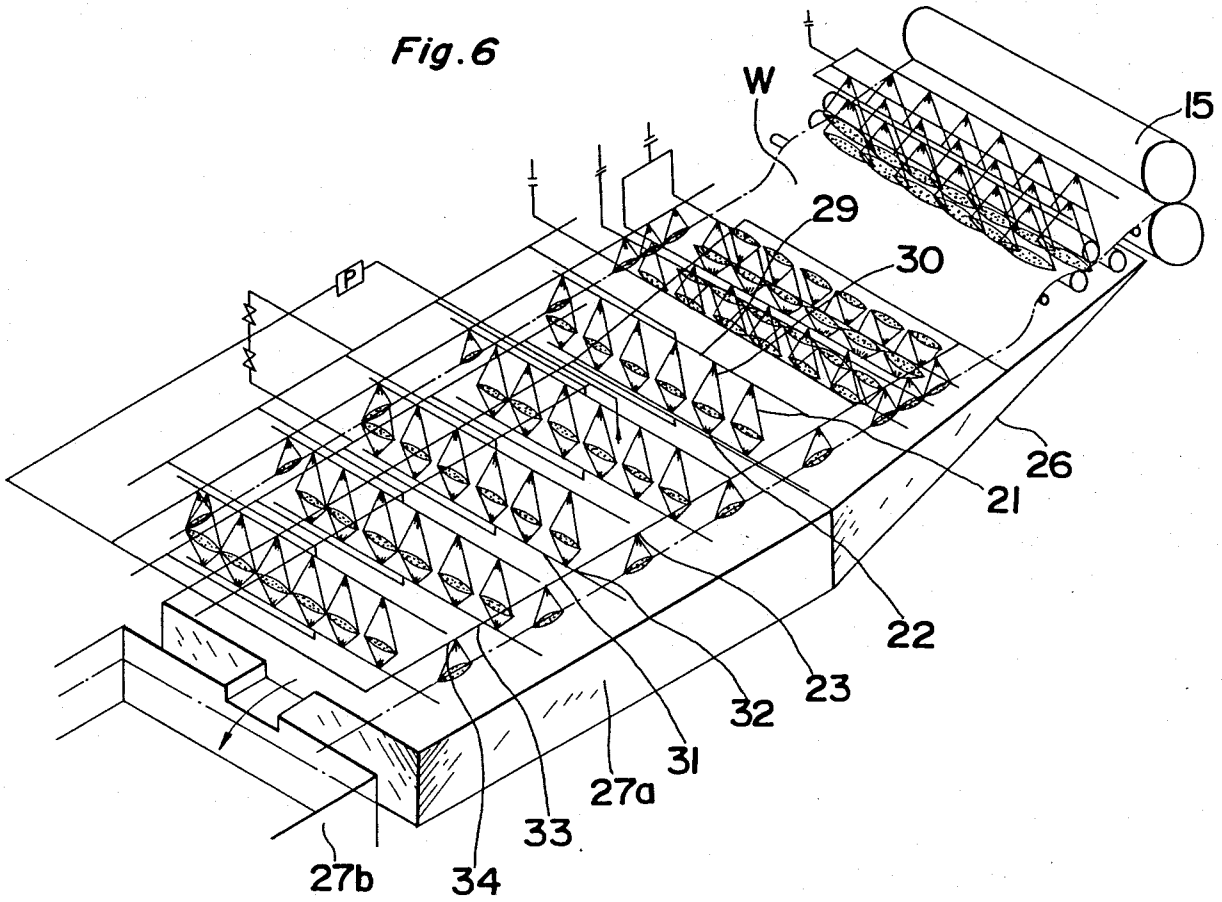
FIG. 6 is a perspective view of the washing device of FIG. 1, partially on an enlarged scale.

Referring now to the drawings, there is shown in FIGS. 1 and 2 the mercerization machine of a knitted work equipped with a washing device embodying the method of the present invention, FIG. 1 being a front elevational view and FIG. 2 being a plan view thereof.

In accordance with the present invention, the mercerization treatment of the knitted work is performed by the former process of caustic alkali treatment and the latter process of washing treatment in series. In other words, the knitted work cut open into the form of an unfolded cloth W is, while it undergoes the former process of caustic alkali treatment and the latter process of washing treatment, transferred in the lengthwise direction at a constant speed from a supply position A to be taken out of a take-out position B. In the former process, the knitted work cut open in the form of an unfolded cloth is soaked in a tank 1 containing therein a solution of caustic soda so as to be processed by the caustic soda. During this period of time, the knitted work W is kept in contact with rollers in the tank, with neighboring rollers being in touch with each other.

On the other hand, in the latter process, the knitted work is transferred in one direction by a tenter 10 while it is washed by water sprayed out from an upper nozzle member 21 and a lower nozzle member 22 respectively provided above and below the tenter 10 such that the knitted work is removed from the caustic alkali.

The tenter 10 is a known transferring means such as a so-called tenter conveyor, which transfers the knitted work in the lengthwise direction. At this time, the left and right opposite ends of the knitted work are freely detached from the tenter 10. More specifically, the tenter 10 comprises a pair of right and left endless plate conveyors 11, a plurality of transfer plates 12 provided on said conveyors 11, a presssing roller 14 for securing the opposite ends of the knitted work W to support needles 13 provided with said transfer plates 12, and a take-up roller 15 for disengaging the knitted work W secured to said support needles 13 from the needles.

When the knitted work W, after being treated in the former process is sent onto the tenter 10, the knitted work W has, without extending in the widthwise direction and shrinking in the lengthwise direction, the left and right opposite end portions thereof put on respective left and right plate conveyors 11 sequentially. Concurrently with this, the opposite end portions of the knitted work W are pressed down by the pressing roller 14 so as to be stuck by the needles 13 on the transfer plates 12, and then the knitted work W is successively transferred in the transfer direction of the plate conveyors 11, along with the transfer plates 12. Upon reaching the distal end of the plate conveyors 11, the knitted work W is taken up by the take-up roller 15 such that the opposite ends of the knitted work are slipped out of the needles 13 on the transfer plates 12.

In the manner as described above, the knitted work W is transferred by the tenter 10 in the lengthwise direction thereof in the state that it is generally strained in the widthwise direction, with the opposite end portions thereof supported by the transfer plates 12.

Means for the washing treatment provided above and below the tenter 10 includes an upper nozzle member 21 which shoots a jet of water generally uniformly from above the knitted work W in the widthwise direction thereof, a lower nozzle member 22 provided opposite to the upper nozzle member 21 for shooting a jet of pressed water from below the knitted work W in the widthwise direction thereof, and an end nozzle member 23 for shooting a jet of pressed water generally uniformly from above the knitted work W against the portion of the knitted work supported by the transfer plates.

The washing device further includes a supply means 24 which supplies pressed water to each of the above nozzle members 21, 22 and 23. A control means 25 controls and adjusts the amount of water supplied from the supply means to the nozzle members. Also included in the washing device are a tray 26 for receiving the water falling down after being shot against the knitted work W from the nozzle members 21, 22 and 23, pits 27 provided in plural stages and, a heating means 28 for controlling the temperature of water in each pit. The upper nozzle member 21 is provided with at least more than one nozzle 30 below a straight header 29 formed a predetermined height above the knitted work and over the whole length in the widthwise direction of the knitted work. The nozzle 30 is directed downwards. When the pressed water is supplied to the header pipe 29, the jet of water comes out of the nozzle 30 to be shot against the knitted work W in the form of an unfolded cloth generally uniformly in the widthwise direction of the knitted work W.

Figure 7:
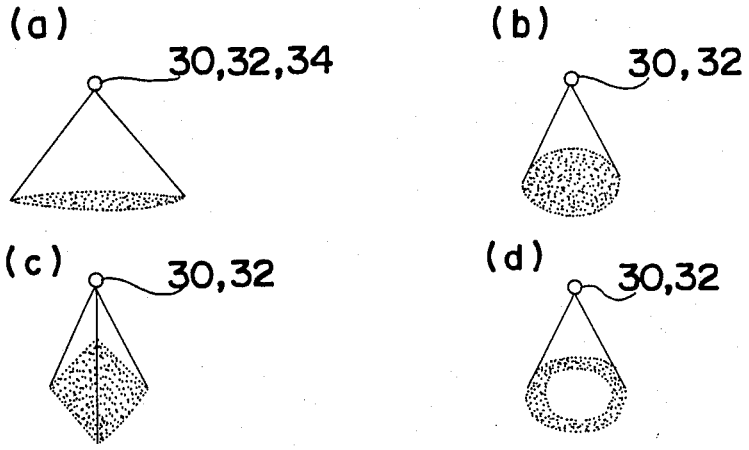
FIGS. 7(*a*) through 7(*d*) are views showing various kinds of nozzles.
Figure 8:
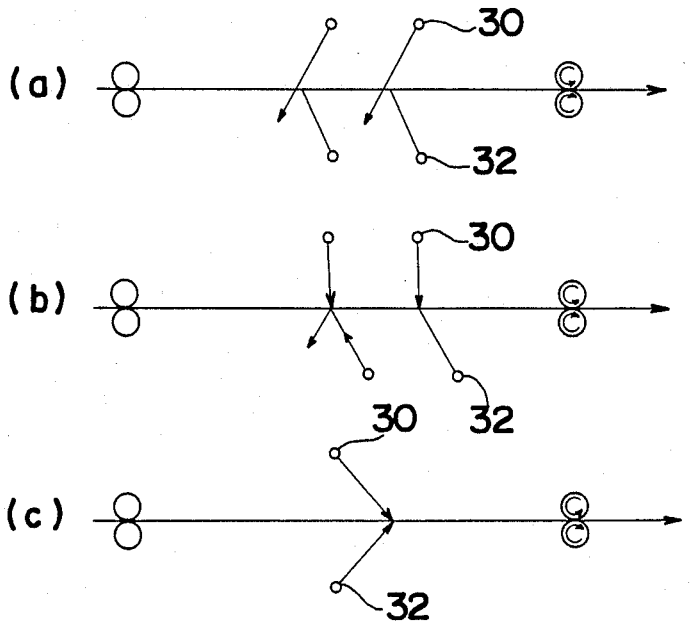
FIGS. 8(*a*) through 8(*c*) are views respectively showing the arrangement of nozzles.

Therefore, it is preferable that the nozzle 30 is of a type that can shoot uniform and corpuscular drops of water in the form of mist with a constant pressure of water and in the wide angle range, for example, a fan shape nozzle (FIG. 7(*a*)) which shoots mists of water long in the widthwise direction, a full conical shape nozzle (FIG. 7(*b*)), a full pyramid shape nozzle (FIG. 7(*c*)) or a vacant conical shape nozzle (FIG. 7(*d*)) may be employed. Further, it is most effective that the angle of the nozzle 30 provided with the header pipe 29 is determined in such a manner that the mists of water be sprayed generally at right angles relative to the surface of the knitted work W transferred along the tenter 10, as shown in FIG. 8(*a*). For instance, the nozzle 30 is preferable to be placed at the inclination of 30° with respect to the transfer direction of the knitted work. However, if the nozzle 30 is placed at the inclination of 30° along the transfer direction of the knitted work as shown in FIG. 8(*c*), the knitted work can be transferred by the power of the sprayed water.

When the pressure of the water shot out of the nozzle 30 is low, the washing efficiency is decreased due to the small amount of water supplied. On the contrary, when the water pressure is extraordinarily high, there arises a danger that the knitted work is exposed to damage. Therefore, the water pressure is controlled without a predetermined range, for example, at 2 kg–8 kg such that the knitted work is effectively washed with water from the nozzle 30 as if it were rubbed and squeezed. The header pipe 29 provided with the nozzle 30 is so arranged that the inclination angle thereof with respect to the transfer direction of the knitted work W can be freely adjusted, and accordingly, the inclination angle of the header pipe 29 can be changed in accordance with the change of the width of the knitted work, thereby it becoming possible that the jet of water is shot out of the nozzle 30 uniformly over the whole width of the knitted work at all times. There are provided at least more than two header pipes 29 along the transfer direction of the knitted work spaced a given distance from each other. A number of header pipes should be provided with narrow intervals therebetween near the take-up roller 15 where the washing treatment of the knitted work is completed. As a result of this, the total amount of the washing water can be controlled. The header pipes 29 are, seen from the transfer direction of the knitted work, formed into units each having a plurality of pipes and corresponding to the tray 26 or the pit 27 formed below the knitted work.

The lower nozzle member 22 is provided with at least more than one nozzle 32 over a straight header pipe 31 which is formed a predetermined distance below the knitted work and extending the whole widthwise length of the knitted work, in the same manner as the upper nozzle member 21. When the header pipe 31 directed upwards is supplied with pressed water from the supply means, the nozzle 32 shoots out the jet of water against the knitted work generally uniformly in the widthwise direction.

Although the nozzle 30 of the upper nozzle member 21 is of the same structure as the nozzle 32 of the lower nozzle member 22, the former is placed at the position slightly nearer to the knitted work than the latter so as to shoot a stronger jet of water. In other words, the knitted work W is sprayed at the surface thereof with the jet of water from the upper nozzle member 21, while it is sprayed at the reverse surface thereof with the jet of water from the lower nozzle member 22. Consequently, at this time, the knitted work, while being strained by the jet of water from upper and lower nozzle members 21 and 22, is generally placed at a fixed position relative to the transfer direction, thereby to prevent the washing efficiency from being lowered which may result from the facts that the knitted work is undesirably imposed with load during the transfer, or it hangs down or is blown up by the jet of water. For the above purpose, it should be so arranged that the nozzle 32 of the lower nozzle member 22 shoots a stronger jet of water against the reverse surface of the knitted work than that sprayed against the surface of the knitted work from the nozzle 30 of the upper nozzle member 21, which stronger jet of water covers the weight of the knitted work itself and the gravity of the jet of water falling down from the nozzles 30 and 32.

Moreover, when a point where the jet of water is shot against the reverse surface of the knitted work from the nozzle 32 of the lower nozzle member 22 roughly coincides with a point where the jet of water is shot against the surface of the knitted work from the nozzle 30 of the upper nozzle member 21, the upward force of the jet of water is cancelled with the downward force thereof and, accordingly, no excessive load is imposed on the knitted work. The end nozzle member 23 has at least more than one nozzle 34 directed downwards and provided with a header pipe 33 which is formed a predetermined distance above the knitted work and along the opposite end portions of the knitted work. The nozzle 34 shoots the jet of water towards the opposite ends of the knitted work generally uniformly against the portion where the knitted work is supported by the transfer plates 12 of the plate conveyors 11.

The end nozzle member 23 has the same structure as the nozzle 30 of the upper nozzle member 21. The opposite ends of the knitted work are washed only by the jet of water shot out of the nozzle 34 of the end nozzle member 23. The nozzle 34 is so designed as to shoot out the jet of water more strongly than the nozzles 30 and 32 of the upper and lower nozzle members 21 and 22, displaying higher washing efficiency and, at the same time, effecting the extension of the opposite ends of the knitted work which are easily tucked in during the former process, that is, effect a so-called selvage opening.

In the mercerization machine of knitted work having the construction as described above, when the knitted work, after being subjected to the former process, is sent into the tenter 10, the knitted work is held at the opposite ends thereof by the transfer plates 12 of the plate conveyors 11 respectively provided at the left and right sides of the machine, while being strained in the widthwise direction by the pressing roller 14. Then, the knitted work is successively transferred in the lengthwise direction thereof by the tenter 10. During this period of time, the knitted work is washed over the whole widthwise length, including the opposite end portions thereof, by the water sprayed from the upper, lower and end nozzle members.

In other words, for the washing device installed at the part of the tenter, there are provided, in addition to the tenter 10 which transfers the knitted work in the lengthwise direction while the opposite ends of the knitted work are detachably held, the upper nozzle member 21 for shooting out the jet of pressed water from above the knitted work generally uniformly against the knitted work in the lengthwise direction, the lower nozzle member 22 opposed to the upper nozzle member 21 for shooting out the jet of water from below the knitted work generally uniformly in the widthwise direction, the control means 25 for controlling the amount of the jetted water from the upper and lower nozzle members 21 and 22 so as to place the knitted work generally at a fixed position with respect to the transfer means, and the end nozzle member 23 for shooting out the jet of water against the supported end portions of the knitted work generally uniformly in the widthwise direction, whereby the knitted work is, while being strained in the widthwise direction and transferred in the lengthwise direction by the tenter 10, sprayed with the jet of water from the upper and lower surfaces thereof by the upper and lower nozzle members 21 and 22, the amount of the jet of water being determined at a given value by the control means, such that the knitted work thus provided at a fixed position with respect to the transfer direction is washed all over the upper and lower surfaces thereof and, at the same time, the opposite end portions held by the support plates are washed by the jet of water from the end nozzle member 23. Thereafter, the washed knitted work is separated from the transfer plates 12 by the take-up roller 15 to be taken out of the tenter 10.

As is described hereinabove, since the washing device installed at the part of the tenter 10 washes the knitted work with the help of the jet of water shot out of the pair of nozzle members 21 and 22, the washing treatment can be effectively performed in a short period of time, consuming the least amount of water. Particularly, when the jets of water from above and below the knitted work are so arranged as to be shot out in face-to-face relation with each other and, accordingly, an extraordinary tension or load to be imposed on the knitted work by the jets of water is restricted, the knitted work can be prevented from being damaged or undesirably extended or shrunken.

Moreover, since the knitted work repeatedly undergoes moderate expansion and shrinkage owing to the jets of water from above and below the knitted work, not only can it be effectively washed, but the quality of the knitted work after the washing can be improved. Further, the knitted work is washed by the jet of water from the upper, lower and end nozzle members in the strained condition while it is transferred on the tenter, and therefore, the washing treatment can be carried out in such a manner that the size and configuration of the knitted work are maintained constant. In addition, there is no necessity, unlike in the prior art method, to dispose a cistern for the washing treatment behind the tenter.

Accordingly, the method of the present invention is advantageous in that the washing device requires only a small space and a small amount of water. For example, by using the washing device having the construction in accordance with the present embodiment, when the knitted work which contains approximately 25% caustic soda before the washing is, while it is transferred at the speed of 20 m/min, sprayed for the distance of about 10 m by the jet of water at the strength of 10 ton/hour, at the pressure of 5 kg/cm$^2$ and at the temperature of 60° C. from 150 fan shape nozzles of the upper, lower and end nozzle members, the knitted work is found to show a pH of about 7 when it is taken out by the take-up roller. As a result, it is proven that the washing device of the present invention can do the washing with half the amount of water required by the prior art device and, moreover, the quality of the knitted work after the washing is excellent without expansion and shrinkage. Further, it is advantageous in accordance with the present invention that the whole length of the machinery employed for the method of the present invention can be remarkably reduced, thereby to decrease the area of the factory site or the building as well, on a large scale.

One example of the present invention will be described hereinbelow.

A cylindrical knit knitted 160 cm in width and 50 m in length only by cotton shrinks to be 144 cm long and extends to be 55 m long through the scouring (or degumming) and bleaching treatment. Thereafter, the above cylindrical knit is treated by a shrink-proofing apparatus (the width of which is set to be 160 cm) in order to correct or remove the strain, thereby being returned to the first state where it shows 160 cm wide and 50 m long. The cylindrical knitted work subsequently goes through a cutting tool to be unfolded into the form of a cloth, which (the knitted work W in the form of an unfolded cloth) is then passed through the guide rollers provided in the tank 1 containing a solution of caustic soda therein for the caustic alkali treatment. Then, the thus caustic alkali treated knitted work is put on the tenter 10 (so-called tenter conveyor) running at the same speed as that of the rotation of the guide rollers. While the left and right end portions of the unfolded knitted work are held to maintain constant the width of the knitted work, the knitted work is successively transferred by the tenter 10. During this period of time, the caustic soda is washed out of the knitted work by the water jetted out of a plurality of showers provided above and below the tenter, that is, from each of the upper, lower and end nozzle members 21, 22 and 23. The knitted work washed out of the caustic soda in the above manner is taken up by the take-up roller 15 provided next to the last portion of the tenter 10, and is then sent out from the tenter 10 towards the take-out opening, thus completing the caustic alkali treatment of the knitted work.

As is clear from the foregoing description, in accordance with the method of caustic alkali treatment of the present invention, since the knitted work extended in the lengthwise direction and shrunken in the widthwise direction due to the scouring (or degumming) and the bleaching treatment is, after being returned to the condition of the length and the width before the scouring (or degumming) and bleaching treatment, above to be subjected to the caustic alkali treatment and the washing treatment as it is, the knitted work can be obtained in a natural state such as when it is knitted by a knitting machine. Therefore, the knitted work is never short of width as is the case with the prior art method of treatment. It is accordingly meritorious that a product made of the knitted work never shrinks in the wash, and can sufficiently withstand drying, even in a drier of the tumble-dry system, after the washing.

Moreover, according to the present invention, the washing treatment is conducted in such a manner that the knitted work on the tenter is showered with water from above and below the tenter, which shower of water from above and below the tenter is arranged to clash with each other, and thus, the knitted work is free from undesirable tensile force or load to be imposed thereon, without any favorable damage or expansion and/or shrinkage. Also, owing to the above shower of water from above and below the tenter, the moderate and repeated expansion and shrinkage of the knitted work becomes effective when the knitted work undergoes the washing treatment, resulting in a rubbing effect, improving the touch of the knitted work.

It is needless to say that the knitted work is lustered well because it is subjected to the scouring (or degumming) and the bleaching treatment before the caustic alkali treatment. Further, since the knitted work is treated at the same speed throughout the caustic alkali treatment and the washing treatment, there is no possibility that a gap is brought about in the interval between woofs. Accordingly, the present invention realizes perfect caustic alkali treatment for knitted work, and it is quite valuable in industrial use.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method for the caustic alkali treatment of knitted work, comprising the steps of, in succession:

(a) subjecting knitted work of cylindrical shape to a scouring and bleaching treatment, whereby it is expanded in the lengthwise direction and shrunk in the widthwise direction, whereby the knitted work is under a strain;

(b) subjecting said knitted work from step (a) to shrink-proofing by passing it through a shrink-proofing apparatus, to thereby restore said knitted work to its original dimensions prior to step (a) and whereby said strain is removed;

(c) cutting open the knitted work of cylindrical shape into the form of an unfolded cloth with end portions on two sides, by a cutting tool;

(d) passing the unfolded cloth of step (c) through a solution of caustic alkali in a tank under the guidance of rollers which contact each other so that the unfolded cloth is always kept in contact with the rollers while being processed by the caustic alkali;

(e) transferring the unfolded cloth of step (d) to a tenter which is provided in succession to said tank of step (d) and moving said unfolded cloth at the same speed as that at which the unfolded cloth is passed through the tank of caustic alkali solution so that the unfolded cloth is transferred by the tenter in the lengthwise direction under a condition whereby it is generally strained in the widthwise direction while keeping the end portions thereof freely detached from the tenter and supported by the tenter during transfer and (f) washing the unfolded cloth being transferred on the tenter by shooting a jet of water from above and below the unfolded cloth in the widthwise direction thereof so as to remove the caustic alkali from the unfolded cloth by the jets of water, said caustic alkali treatment of step (d) and washing treatment of step (f) being performed in a such a manner that the size and configuration of the knitted work are maintained in the original state prior to step (a).

2. The method according to claim 1 wherein the washing step (f) is performed so that the jet of water from above and below the unfolded cloth results in repeated expansion and shrinkage of the knitted work, resulting in a rubbing effect, thereby improving the quality of the knitted work.

3. The process according to claim 1 wherein the jets of water from above and below the knitted work are so arranged so to contact the knitted work in a substantially face-to-face relationship with each other, thereby avoiding extraordinary tension or load on the knitted work.

4. The process according to claim 3 wherein the jets are inclined at an angle of about 30° with respect to the transfer direction of the knitted work.

* * * * *